US005693280A

United States Patent [19]

Pellegrin et al.

[11] Patent Number: 5,693,280

[45] Date of Patent: Dec. 2, 1997

[54] METHOD OF PRODUCING ORGANIC FIBERS FROM A ROTARY PROCESS

[75] Inventors: Michael T. Pellegrin; James E. Loftus; Virgil G. Morris, all of Newark; Randall M. Haines, Frazeysburg, all of Ohio

[73] Assignee: Owens-Corning Fiberglas Technology, Inc., Summit, Ill.

[21] Appl. No.: 690,614

[22] Filed: Jul. 31, 1996

[51] Int. Cl.[6] ..... D01D 5/18

[52] U.S. Cl. ..... 264/211.1; 65/521; 425/464

[58] Field of Search ..... 264/6, 8, 115, 264/121, 211.1, 211.11; 425/8, 464; 65/470, 521

[56] References Cited

U.S. PATENT DOCUMENTS

| | | | |
|---|---|---|---|
| 5,242,633 | 9/1993 | Rook et al. | 264/8 |
| 5,326,241 | 7/1994 | Rook et al. | 425/7 |
| 5,458,822 | 10/1995 | Bakhski et al. | 264/6 |

OTHER PUBLICATIONS

"New Economic Method To Produce Polyester Bicomponent Fibers" by W. Stibal, G. Schach Ems-Inventa AG, Domat/Ems, Switzerland, Journal Name: Chemical Fibers International, vol. 45(4) 1995, pp. 296–301.

*Primary Examiner*—Leo B. Tentoni

*Attorney, Agent, or Firm*—C. Michael Gegenheimer; Curtis B. Brueske

[57] ABSTRACT

A method for fiberizing organic material includes rotating a spinner having a bottom wall and a peripheral wall that extends upwardly from the bottom wall and terminates in an upper end, wherein the spinner has a cavity defined by the bottom wall, the peripheral wall and a plane extending through the upper end of the peripheral wall generally parallel to the bottom wall. The method further includes creating turbulence within the spinner cavity, supplying molten organic material to a delivery tube wherein the delivery tube terminates at a point located outside of the spinner cavity, discharging molten organic material from the delivery tube with enough momentum to overcome the turbulence and reach a predetermined location in the spinner cavity, and centrifuging fibers from the molten organic material.

20 Claims, 3 Drawing Sheets

METHOD OF PRODUCING ORGANIC FIBERS FROM A ROTARY PROCESS

TECHNICAL FIELD

This invention relates to the production of organic fibers, and more particularly, to forming organic polymer fibers from a centrifuge or rotary spinner.

BACKGROUND OF THE INVENTION

Products, such as insulation and structural products, have been made from mineral fibers, particularly glass fibers, for some time. A well known method of making glass fibers includes centrifuging molten glass through small holes to form glass fibers. A delivery tube supplies molten glass to a rotating cylindrical spinner. The spinner has a peripheral wall with plurality of small holes. The spinner is heated to keep the glass in the molten state. As the spinner is rotated, centrifugal force moves the molten glass against the peripheral wall. The molten glass is centrifuged from the rotating spinner and forced through the peripheral holes to form glass fibers. This procedure provides an efficient way of producing glass fibers at high production rates.

Many uses for organic fibers, such as polymer fibers, have been developed because of the desirable qualities of organic fibers. For example, polymer fibers can be used to produce insulation products having a great degree of flexibility. Polymer fibers are more resistant to breaking under deflection than glass fibers in typical insulation products. These polymer fiber insulation products also have better handleability than glass fibers because they do not irritate the skin. Polymer fibers can be used in a wide range of products including thermal and acoustical insulation, filters, and sorbent materials.

To take advantage of the proven manufacturing procedures acquired in producing glass fibers, it would be desirable to be able to produce organic fibers, including polymer fibers, in a similar way. But, molten organic material has different characteristics from molten glass which prevents the direct transfer of production technology. Molten glass has a specific gravity in the range of 2.2 to 2.7 whereas molten polymeric material has a specific gravity in the range of 0.9 to 1.9. As a spinner rotates, wind currents or turbulence are created within the spinner cavity. Also, heated air used to heat the spinner creates turbulence. Molten glass is dense enough not to be significantly disturbed by the turbulence as it is supplied to the spinner, but turbulence within a spinner can disrupt the path of organic material as it exits the delivery tube and prevent the organic material from reaching the desired location. Such disrupted organic material may not sufficiently cover the peripheral wall of the spinner and it may even be ejected from the spinner. Without sufficient coverage of the peripheral wall, the centrifugation is interrupted, resulting in undesirable discontinuities in the fibers. It is desirable to provide a suitable way of supplying molten organic material to the rotating spinner which prevents the material film being disrupted before it reaches the desired location within the spinner.

SUMMARY OF THE INVENTION

The above object as well as other objects not specifically enumerated are accomplished by a method of manufacturing organic fibers in accordance with the present invention. The method for manufacturing organic fibers of the present invention includes rotating a spinner having a bottom wall and a peripheral wall that extends upwardly from the bottom wall and terminates in an upper end, wherein the spinner has a spinner cavity defined by the bottom wall, the peripheral wall and a plane extending through the upper end of the peripheral wall generally parallel to the bottom wall. The method further includes creating turbulence within the spinner cavity, supplying molten organic material to a delivery tube, wherein the delivery tube terminates at a point located outside of the spinner cavity, discharging molten organic material from the delivery tube with enough momentum to overcome the turbulence and reach a predetermined location in the spinner cavity, and centrifuging fibers from the molten organic material.

The objects of the invention are also accomplished by an apparatus for fiberizing molten organic material, which includes a centrifugal spinner having a bottom wall and a peripheral wall extending upwardly from the bottom wall and terminating in an upper end, wherein the spinner includes a spinner cavity defined by the bottom wall, the peripheral wall and a plane extending through the upper end of the peripheral wall generally parallel to the bottom wall. The apparatus further includes means for discharging molten organic material with enough momentum to reach a predetermined location within the spinner cavity, wherein the discharging means terminates at a point located above the plane.

DETAILED DESCRIPTION

Figure 1:
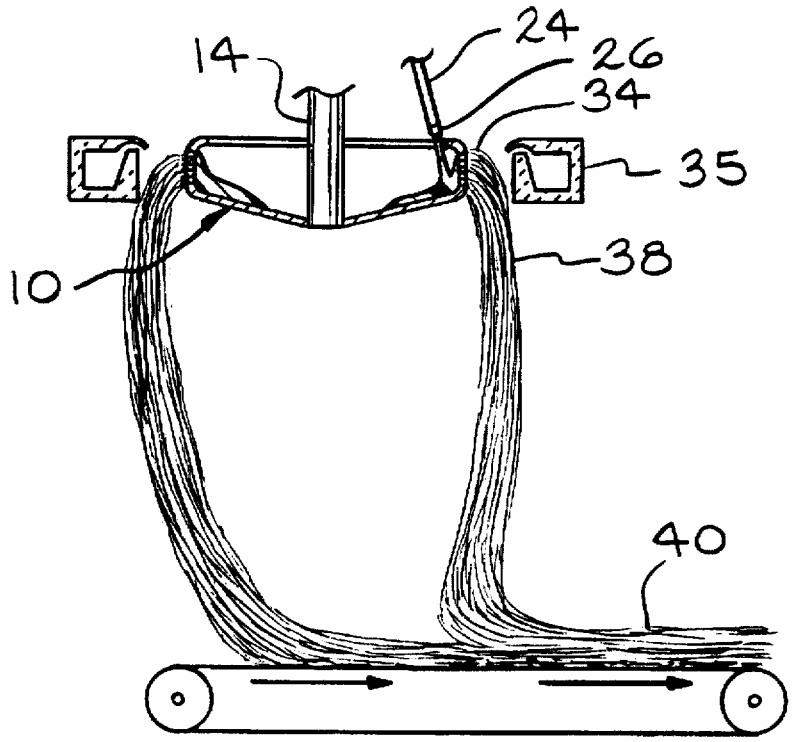
FIG. 1 is a schematic cross-sectional view in elevation of an apparatus for producing polymer fibers according to the principles of the invention.
Figure 2:
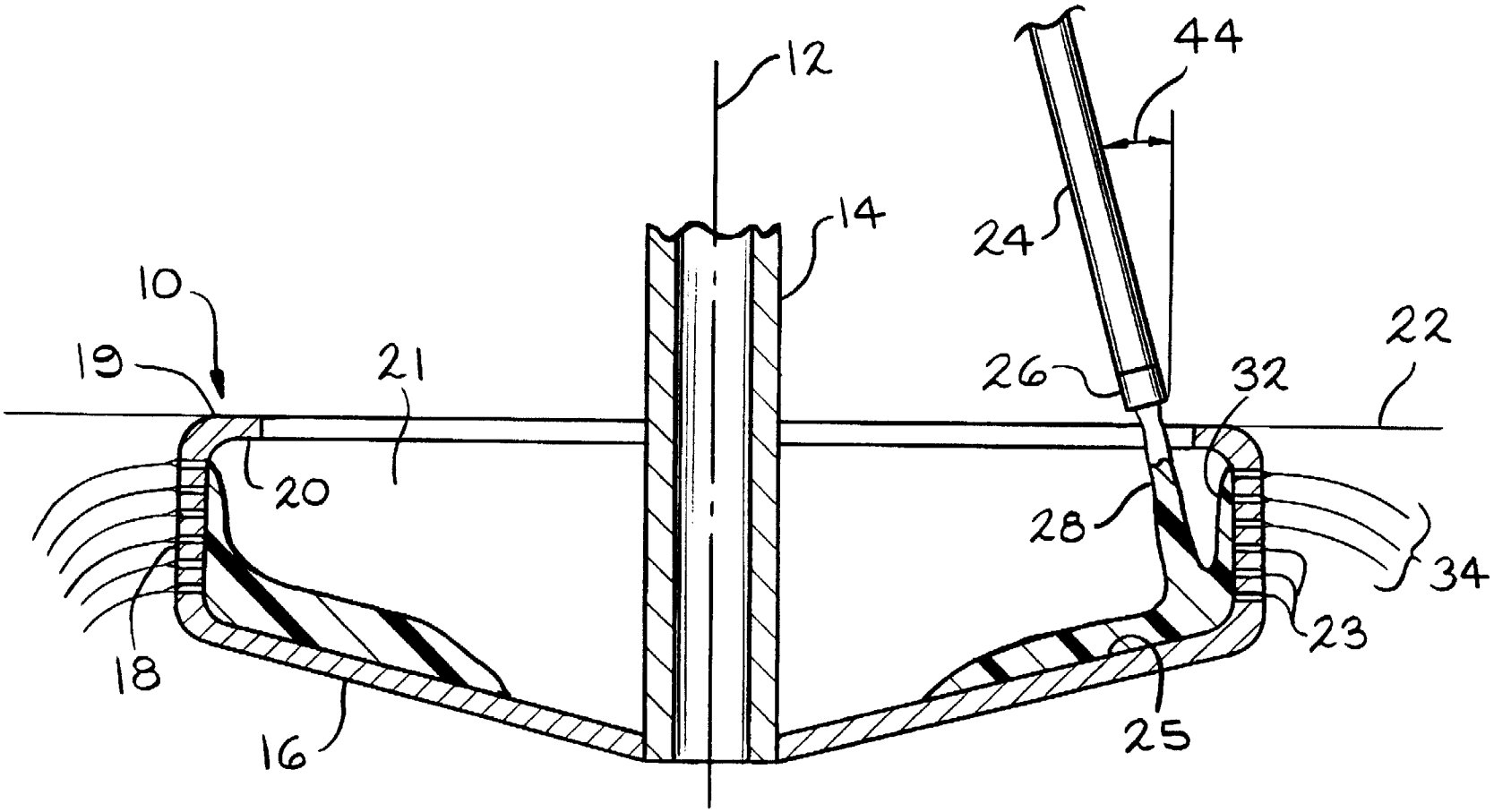
FIG. 2 is a cross-sectional view in elevation of a spinner of the apparatus shown in FIG. 1.

A method and apparatus for manufacturing organic fibers from molten organic material is described hereinbelow. As shown in FIGS. 1 and 2, a spinner 10 rotates on an axis of rotation 12 and is driven by shaft 14, typically at a rate within the range of about 1000 to about 7000 RPM. The spinner includes a bottom wall 16, a peripheral wall 18 which extends upwardly from the bottom and terminates in an upper end 19, and a flange 20 which extends radially inwardly from the upper end 19 of the peripheral wall 18. A spinner cavity 21 is defined between the bottom wall 16, the peripheral wall 18 and a plane 22 extending through the upper end 19 of the peripheral wall 18 generally parallel with the bottom wall 16. The peripheral wall has between about 100 and about 15,000 orifices 23 for the centrifugation of organic fibers, and preferably has between about 500 and about 2,500 orifices. The spinner can be cast from a nickel/cobalt/chromium alloy as used for the production of glass fibers, or can be any other suitable spinner such as one made from welded stainless steel. The diameter of the spinner can range from 20 cm to 100 cm, with a preferable diameter of about 40 cm. The spinner is heated to keep organic material within the spinner cavity in a molten state. A preferable heating method uses blowers (not shown) to force heated air into the spinner cavity, but any method of heating the spinner including induction heating may be used.

Currents of moving air or turbulence are created within the spinner cavity. There can be several causes of the turbulence. At a minimum, rotation of the spinner creates a swirling movement of air within the spinner cavity. Also, if blowers are used to heat the material within the spinner, they can create turbulence. Other causes of turbulence may also exist. Such turbulence can create undesirable effects as will be discussed below.

As shown in FIG. 2, discharging means in the form of a delivery tube 24, which includes and terminates in a nozzle 26, supplies the rotating spinner 10 with a molten stream of organic material 28. The delivery tube and nozzle are positioned outside the spinner cavity 21, which allows for visual inspection of the molten organic stream for diagnostic purposes. Visual inspection of the stream provides information about variability in the quality of the material 28, the material temperature, and whether pluggage has occurred upstream.

The discharging means or delivery tube 24 transfers the molten organic material from an extruder to a predetermined location 25 within the spinner 10, as explained hereinbelow. The centrifugal force of the rotating spinner moves the molten material within the spinner away from the axis of rotation 12, towards the peripheral wall 18. The peripheral wall must be completely covered with molten material during centrifugation or undesirable discontinuities in the fibers will result. It has been found that a preferable location at which the molten material should be deposited within the spinner to achieve complete coverage of the peripheral wall is at the spinner bottom wall 16 between about 1.25 and about 2.0 cm from the peripheral wall 18. If the molten material is discharged to another location within the spinner, the molten material may not completely cover the peripheral wall 18.

Figure 3:
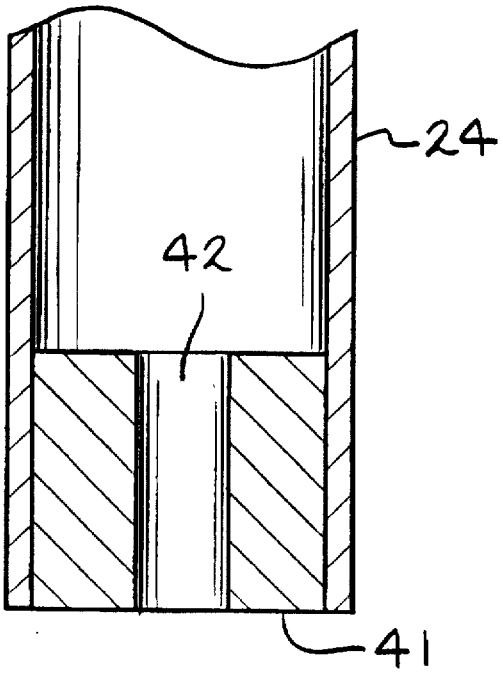
FIG. 3 is a sectional view in elevation of a portion of a discharging means of the apparatus of FIG. 1.
Figure 4:
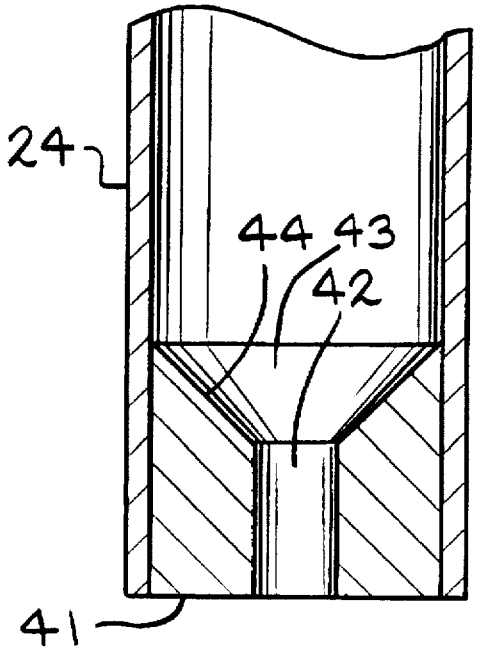
FIG. 4 is a sectional view in elevation of an alternate embodiment of the discharging means.

As shown in FIGS. 3 and 4, the nozzle 26 at the end of the delivery tube 24 consists of a plug 41 having a restricting orifice 42 which reduces the diameter of the flow path of the molten organic material. The diameter of the restricting orifice may range from about 0.125 cm to about 0.5 cm for a polymeric material, with a preferable range being from about 0.25 cm to about 0.31 cm. As shown in FIG. 4, the inlet 43 of the restricting orifice 42 may have tapered sides 44 to reduce plugging. The nozzle plug is preferably constructed of brass, but any suitable material may be used. The outside diameter of the nozzle plug is approximately equal to the inside diameter of the delivery tube. The plug may be pushed into the tube and held in place by a weld. Alternatively, the nozzle could be threaded onto the delivery tube. The nozzle could also have a swivel connection (not shown), similar to a shower head, which would allow the stream of molten organic material to be aimed at different locations within the spinner cavity.

As the molten organic material passes through the reduced diameter of the restricting orifice 42, the velocity of the material increases. Since the mass of the material stays constant, the momentum of the material increases as its velocity increases. When the material gains sufficient momentum, it is not as affected by turbulence within the spinner cavity. Accordingly, the aforementioned benefits of locating the discharging means outside the spinner cavity can be achieved, while the undesirable effects of turbulence are reduced or minimized.

The discharge velocity of the material is determined by the specific gravity, the pressure of the material, and the diameter of the restricting orifice. At a constant pressure of the molten material at the extruder, the smaller the restricting orifice diameter, the greater the discharge velocity, and thus momentum, of the molten material. However, the diameter restricting orifice has a greater tendency to plug. At a constant orifice diameter, the greater the pressure of the material at the output end of the delivery tube, the greater the discharge velocity. The pressure can be increased by increasing the pull rate, which is limited by the amount of material passing through the holes of the spinner. The pressure can also be increased by increasing the viscosity of the organic material, but, as the viscosity of the material increases, the material is more likely to harden too quickly to be centrifuged. Also, as the viscosity of the material is increased the molten stream tends to wrap around the spinner shaft 14 within the spinner cavity.

It has been found that the molten material must have a momentum of at least about 100 gcm/sec$^2$ to overcome the turbulence in a spinner with a 40 cm diameter, and momentums of between about 300 and about 500 gcm/see$^2$ are preferred for optimum results. A 0.25 cm restricting orifice discharges polymeric material at about 40 to 55 cm/sec. To achieve a momentum of 100 gcm/sec$^2$, the polymeric material having a discharge velocity of 40 cm/sec must be supplied to the nozzle at a rate, called the pull rate, of 2.5 g/sec.

As shown in FIG. 2, the molten material discharged from the nozzle forms a head or layer 32 covering the spinner peripheral wall 18 within the spinner cavity. The material from the molten layer is centrifuged through orifices 23 to form fibers 34. As shown in FIG. 1, the radially-traveling fibers are turned down by blower 36 into a cylindrically shaped veil 38 of fibers, traveling downwardly, i.e. in the direction of the axis of the spinner. The fibers are collected to form a pack 40 which is used to produce a fiber product.

It is to be understood that any organic material capable of being fiberized can be supplied to the spinner. Particular examples of suitable polymers include polyethylene terephthalate (PET), polypropylene or polyphenylene sulfide (PPS). Other organic materials suitable for making fibers include nylon, polycarbonate, polystyrene, polyamide, various polyolefins, asphalts and other resins and thermoplastic or thermoset materials.

If the organic material is polymeric, such as PET, it can be supplied in the molten state from extruder equipment (not shown) commonly known to those in the art of polymeric materials. The temperature at which the molten organic material is supplied to the spinner depends upon the nature of the material. Polypropylene would typically have a temperature of about 260 degrees C. as it emerges from the extruder. Asphalt would typically run cooler, at about 200 degrees C., while PPS would typically run hotter, at about 315 degrees C. The molten organic material preferably leaves the extruder at a pressure of between about 2,000 kPa to about 15,000 kPa, and it preferably reaches the discharging means at a lower pressure, preferably less than about 700 kPa.

The tube 24 is preferably angled with respect to vertical to aim the discharged molten material at the optimum location, and most preferably angled about 12 degrees, but the angle can be varied depending on the dimensions and rotational speed of the spinner. The delivery tube is preferably constructed of stainless steel tubing but any suitable tubing may be used. The tube may be 5 meters long, or longer, to permit the extruder to be located separately from the spinner to provide greater flexibility in setting up the production equipment. A tube having a 1.25 cm inside diameter is preferably used, but the diameter may vary depending on the length of the tubing and the material used.

Figure 5:
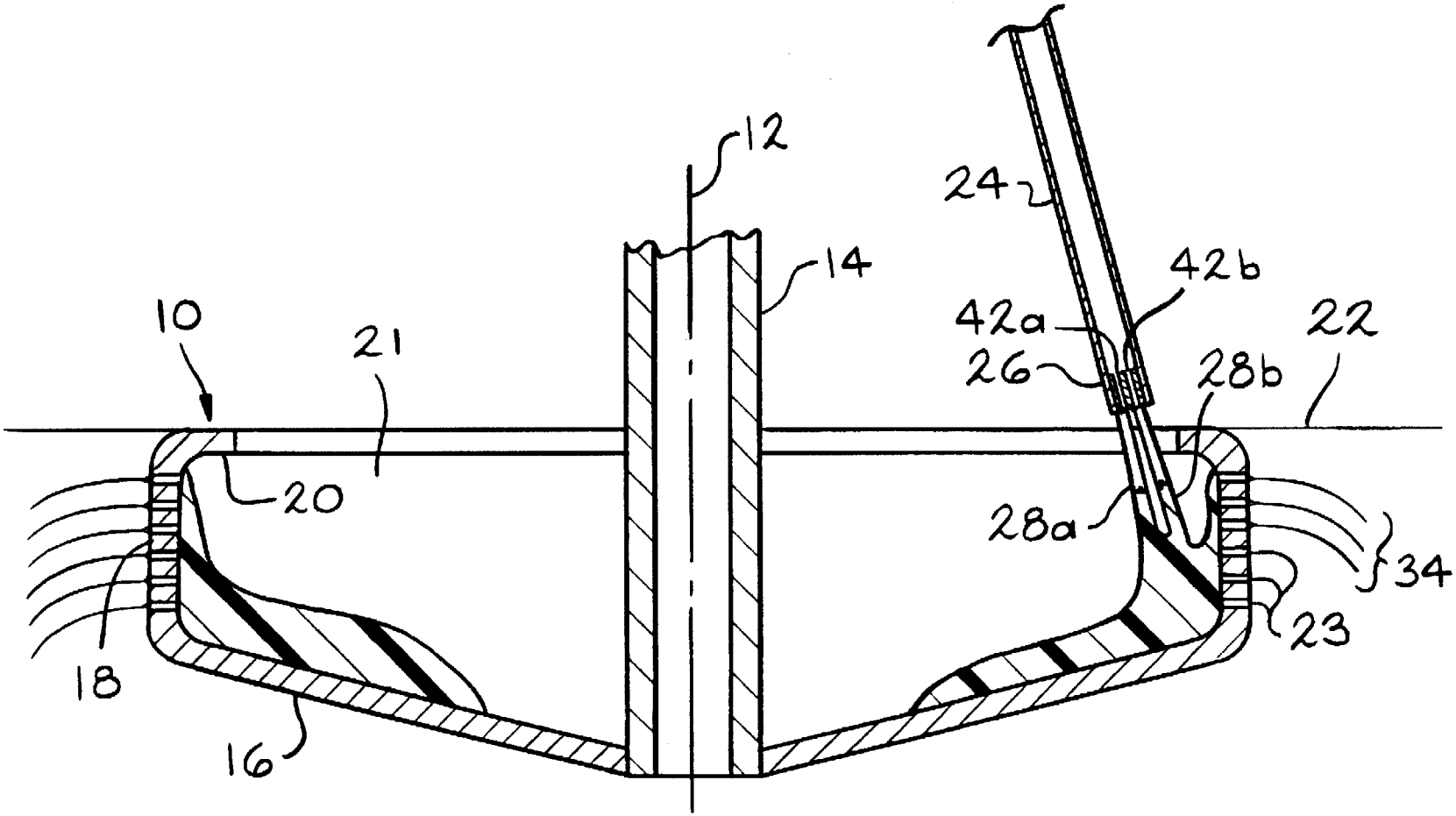
FIG. 5 is a cross-sectional view in elevation of an alternate embodiment of the spinner and discharging means.

As shown in FIG. 5, the nozzle 26 can have two orifices 42*a* and 42*b* to discharge the molten organic material into the spinner in two streams 28*a* and 28*b*. The streams can be aimed at different locations within the spinner cavity to achieve better coverage of the peripheral wall 18 and therefore better centrifugation as described above. More than two orifices may be used to form more streams which can be aimed at several locations within the spinner cavity. In addition, it should be appreciated that discharging means, other than the tube 24 including the nozzle 26, for discharging the molten organic material with enough momentum to reach a predetermined location within the spinner cavity may be used, and at least some of the advantages of the present invention can be achieved thereby.

It should be understood that this invention may be practiced otherwise than as specifically explained and illustrated without departing from its scope.

INDUSTRIAL APPLICABILITY

The invention can be useful in the production of fibrous products of organic fibers for use as structural and insulation products.

We claim:

1. A method for fiberizing organic material comprising rotating a spinner having a bottom wall and a peripheral wall extending upwardly from the bottom wall and terminating in an upper end, the spinner having a cavity defined by the bottom wall, the peripheral wall and a plane extending through the upper end of the peripheral wall generally parallel to the bottom wall, creating turbulence within the spinner cavity, supplying molten organic material to a delivery tube, wherein the delivery tube terminates at a point located outside of the spinner cavity, discharging the molten organic material from the delivery tube with enough momentum to overcome the turbulence and reach a predetermined location in the spinner cavity, and centrifuging fibers from the molten organic material.

2. The method of claim 1 including discharging the molten organic material with a momentum of more than 100 gcm/sec$^2$.

3. The method of claim 1 including discharging the molten organic material with a momentum within the range of from about 300 to about 500 cm/sec$^2$.

4. The method of claim 1 wherein said discharging step includes passing the molten material through a restricting orifice at the termination of the delivery tube, the restricting orifice being positioned at a point that is located above the plane.

5. The method of claim 4 including discharging the molten organic material with a momentum of more than 100 gcm/sec$^2$.

6. The method of claim 1 including discharging the molten organic material from the delivery tube at about 12 degrees from vertical.

7. The method of claim 1 wherein the step of discharging includes discharging tile molten material through a nozzle having a plurality of restricting orifices.

8. The method of claim 7 including aiming the discharged molten organic material towards a plurality of different locations within the spinner cavity.

9. The method of claim 1 wherein the organic material is organic polymeric material.

10. A method for fiberizing organic polymeric material comprising rotating a spinner having a bottom wall and a peripheral wall extending upwardly from the bottom wall and terminating in an upper end, the spinner having a cavity defined by the bottom wall, the peripheral wall and a plane extending through the upper end of the peripheral wall generally parallel to the bottom wall, and thereby creating turbulence within the spinner cavity, supplying molten organic polymeric material to a delivery tube, the delivery tube terminating at a point that is located outside of the spinner cavity, discharging molten organic polymeric material from the delivery tube with enough momentum to overcome the turbulence and reach a predetermined location in the spinner cavity, and centrifuging polymer fibers from the molten organic polymeric material.

11. The method of claim 10 including discharging the molten organic polymeric material with a momentum of more than 100 gem/sec$^2$.

12. The method of claim 10 wherein said discharging step includes passing the molten material through a restricting orifice at the termination of the delivery tube, the restricting orifice having a diameter of from about 0.125 cm to about 0.5 cm and being positioned at a point that is located outside the spinner cavity.

13. The method of claim 10 wherein the step of discharging including discharging the molten material through a nozzle having a plurality of restricting orifices, and aiming the restricting orifices at a plurality of different locations within the spinner cavity.

14. An apparatus for fiberizing molten organic material comprising, a centrifugal spinner having a bottom wall and a peripheral wall extending upwardly from the bottom wall and terminating in an upper end, said spinner including a spinner cavity defined by the bottom wall, the peripheral wall, and a plane extending through the upper end of the peripheral wall generally parallel to the bottom wall, and means for discharging molten organic material with enough momentum to reach a predetermined location within the spinner cavity, said discharging means terminating at a point located above said plane.

15. The apparatus of claim 14, wherein said discharging means includes a delivery tube and a restricting orifice located at the termination of the delivery tube, the restricting orifice being positioned at a location outside the spinner cavity.

16. The apparatus of claim 15 wherein the restricting orifice has a diameter of film about 0.125 cm to about 0.5 cm.

17. The apparatus of claim 14 wherein the delivery tube is angled about 12 degrees from vertical.

18. The apparatus of claim 14 wherein said discharging means includes a delivery tube and a nozzle having a restricting orifice, the nozzle being located at the termination of the delivery tube at a point that is located outside the spinner cavity.

19. The apparatus of claim 18 wherein the nozzle has a plurality of restricting orifices.

20. The apparatus of claim 19 wherein the restricting orifices are aimed at a plurality of different locations within the spinner cavity.

* * * * *

UNITED STATES PATENT AND TRADEMARK OFFICE

CERTIFICATE OF CORRECTION

PATENT NO. : 5,693,280

DATED : December 2, 1997

INVENTOR(S): Michael T. Pellegrin, James E. Loftus, Virgil G. Morris, Randall M. Haines It is certified that error appears in the above-identified patent and that said Letters Patent is hereby corrected as shown below:

In Claim 3, line 3, "cm" should be - -gcm- -.

In Claim 11, line 3, "gem" should be - -gcm- -.

In Claim 16, line 2, "film" should be - -from- -.

Signed and Sealed this

Twenty-first Day of April, 1998

Bruce Lehman

*Attest:*

BRUCE LEHMAN

*Attesting Officer*

*Commissioner of Patents and Trademarks*